United States Patent [19]

O'Connor

[11] Patent Number: 4,876,971

[45] Date of Patent: Oct. 31, 1989

[54] WATER COOLED INCINERATOR

[76] Inventor: Chadwell O'Connor, 2024 Galaxy Dr., Newport Beach, Calif. 92660

[21] Appl. No.: 237,981

[22] Filed: Aug. 29, 1988

[51] Int. Cl.[4] ..... A47J 36/00; A47J 36/24

[52] U.S. Cl. ..... 110/246; 110/234; 110/255; 110/257; 110/289; 110/297

[58] Field of Search ..... 110/234, 246, 248, 255, 110/259, 289, 257, 297

[56] References Cited

U.S. PATENT DOCUMENTS

| | | | |
|---|---|---|---|
| 1,350,865 | 8/1920 | Griffiths | 432/55 |
| 3,577,941 | 5/1971 | Schoppe | 110/246 |
| 3,599,581 | 8/1971 | Schoppe | 110/158 |
| 3,682,117 | 8/1972 | Rousseau | 110/216 |
| 3,727,565 | 4/1973 | Schoppe et al. | 110/214 |
| 3,783,802 | 1/1974 | Schrage | 110/246 |
| 3,813,211 | 5/1974 | Gommesen | 432/80 |
| 3,822,651 | 7/1974 | Harris et al. | 110/234 |
| 3,855,951 | 12/1974 | Giles | 110/216 |
| 3,861,336 | 1/1975 | Koyanagi et al. | 110/234 |
| 4,226,584 | 10/1980 | Ishikawa | 110/246 |
| 4,408,547 | 10/1983 | Autere | 110/246 |
| 4,413,571 | 11/1983 | Hill et al. | 110/234 |
| 4,583,468 | 4/1986 | Reed et al. | 110/246 |
| 4,782,766 | 11/1988 | Lee et al. | 110/246 |

FOREIGN PATENT DOCUMENTS

| | | | |
|---|---|---|---|
| 249034 | 7/1912 | Fed. Rep. of Germany | 110/246 |
| 1751457 | 7/1971 | Fed. Rep. of Germany | 110/246 |
| 1043037 | 9/1966 | United Kingdom | 110/246 |
| 1170548 | 11/1969 | United Kingdom | 110/246 |

*Primary Examiner*—Edward G. Favors
*Assistant Examiner*—Denise L. Ferensic
*Attorney, Agent, or Firm*—Leydig, Voit & Mayer

[57] ABSTRACT

An incinerator having a funnel shaped burning chamber within a firebox with the chamber being formed of water pipes connected to a water circulation system including a steam chest. The chamber is rotated about its axis which is inclined so that the lower conical portion of the chamber is horizontal. Material for burning is driven up the cylindrical portion of the chamber, and combustion air is forced through a nozzle into the open conical portion of the chamber.

4 Claims, 2 Drawing Sheets

WATER COOLED INCINERATOR

BACKGROUND

This invention relates generally to incinerators and more particularly concerns a small volume, water-cooled rotary incinerator.

U.S. Pat. No. 3,822,651, issued July 9, 1974, discloses a form of incinerator that has been become known as a combustor. Such combustors burn municipal waste in rotary, water cooled drums; with the cooling water system generating steam for direct use for power generation. Combustors of this type have proven effective for large volume incineration, such as over 100 tons of material per day, but the design has not been suitable for scaling down for volumes much below that.

Waste disposal of all kinds has become a critical concern, and there is a need for an incinerator suitable for hospital or small industry use that can dispose of material at rates less than 25 tons per day.

Accordingly, it is an object of the invention to provide a small compact incinerator that efficiently burns a wide variety of combustible material. It is a related object to provide an incinerator of this kind that is water cooled so that the fire holding structure is long lasting, and the incinerator is capable of generating steam for useful energy.

SUMMARY

The incinerator includes a funnel shaped burning chamber formed of tubes through which water is circulated. The chamber is rotatably supported on an angle so that the lowermost conical portion of the funnel is horizontal. Combustible material is gravity fed below the cylindrical portion of the funnel chamber and pushed by a double ram feeder up into the conical portion of the chamber. Combustion air is forced directly into the open conical portion of the burning chamber and the chamber is slowly rotated about its axis so as to turn the burning material over and carry it back from the rim of the conical portion until it has been completely burned. The continual press of combustible material into the chamber eventually forces ashes not carried away and material that will not burn to fall over the rim of the conical portion.

DRAWINGS

Other objects and advantages of the invention will become apparent upon reading the following detailed description and upon reference to the drawings, in which.

DESCRIPTION

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
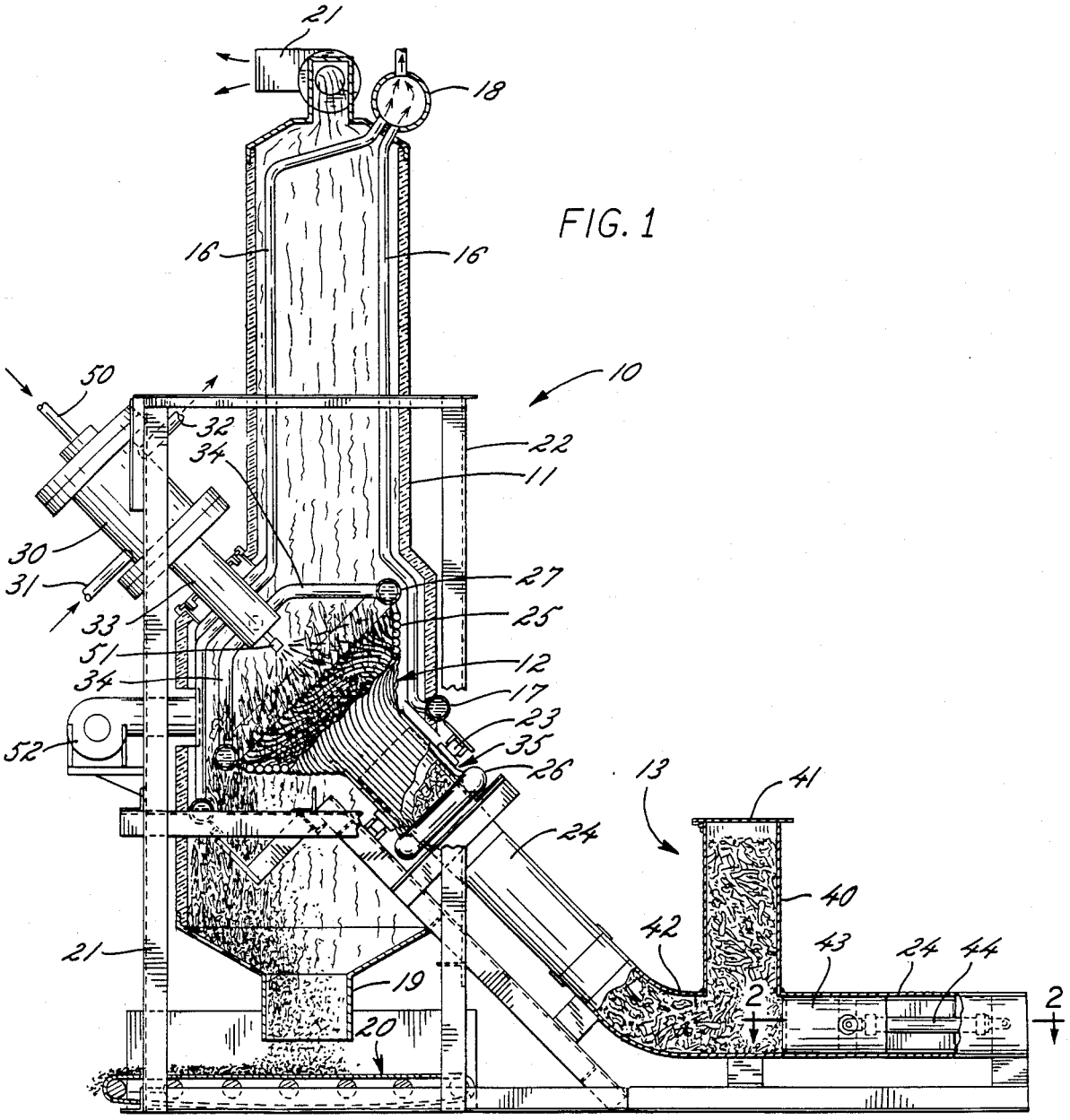
FIG. 1 is an elevation, partially sectioned, of an incinerator embodying the invention.
Figure 2:
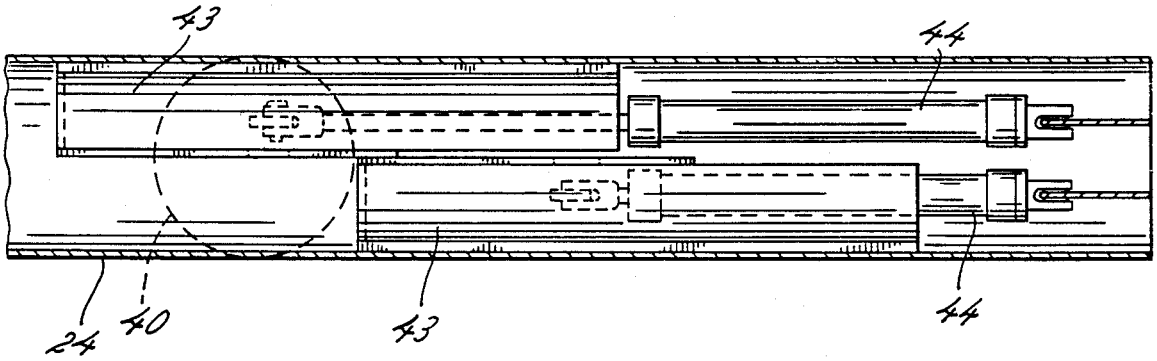
FIG. 2 is a fragmentary section taken approximately along the line 2—2 in FIG. 1.

Turning to FIG. 1, there is shown an incinerator 10 embodying the invention including a furnace or firebox 11 enclosing a burning chamber 12 and a feeding assembly 13. The firebox 11 includes heat extracting water pipes 16 running from a lower manifold pipe 17 to a steam drum 18. The lower portion of the firebox 11 forms a chute 19 which allows ashes and unburnt material to fall onto a removal system 20. The upper portion of the firebox 11 is vented through natural draft or a fan 21 to drive gases of combustion and material carried with them to an appropriate cleaner or filtering system. A frame 22 supports the several portions of the incinerator 10.

Figure 3:
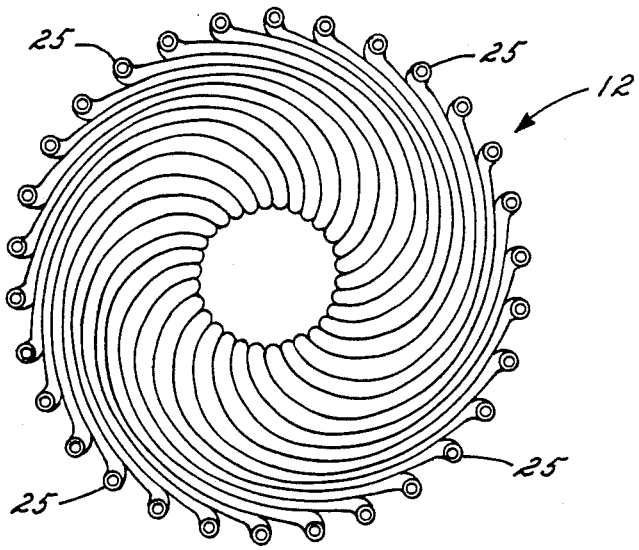
FIG. 3 is a section taken at the outer end of the burning chamber shown in FIG. 1 just behind the manifold tube.

In accordance with the invention, the burning chamber 12 is funnel shaped with upper conical and lower cylindrical portions mounted for rotation within rollers 23 at an angle so that the lowermost conical portion of the chamber is substantially horizontal, and the feeding assembly 13 includes a feeding tube 24 through which material to be burned is directed to and through the cylindrical portion of the burning chamber 12. In the illustrated embodiment, the burning chamber 12 is formed of a plurality of water pipes 25 running parallel and in circular array from a manifold 26, so as to define the cylindrical portion of the chamber, and the pipes are bent outwardly and spiraled to define the conical portion of the chamber (see FIG. 3). The outer ends of the pipes ending the conical portion of the chamber 12 are connected to another manifold 27.

To direct water to and from the pipes 25, a rotary steam joint 30, of the same general type as the joint 35 disclosed in more detail in said U.S. Pat. No. 3,822,651, is mounted on the frame 22 and connected to water inlet and exit lines 31 and 32. The rotary portion 33 of the joint 30 is connected to the manifold 27 by four pipes 34, two of which carry water to the burning chamber 12 and two of which take water and steam from the burning chamber. The manifolds 26, 27 are internally sectioned in the usual manner so that the water pipes 25 are divided into those carrying water to the manifold 26 and those returning the water to the manifold 27. The burning chamber, and of course the rotary portion 33 of the joint 30, are rotatably driven through chain teeth 35 from a power source, not shown.

For feeding material to the burning chamber, the assembly 13 includes a material receiving chute with a sealable cover 41 opening into a portion of the cylindrical feeding tube 24 that, in the described arrangement, is horizontal. With this arrangement the tube 24 thus has a 45 degree bend at 42 between the burning chamber 12 and the chute 40. Alternative configurations may be employed which eliminate this 45° bend.

According to an aspect of the invention there is provided a system for compacting the material within the feeding tube 24. In the embodiment shown a pair of side-by-side, semicircular compacting rams 43 are provided. These rams may be driven by hydraulic cylinders 44 either in unison or alternatively back and forth within the tube 24 beneath the bottom of the chute 40. As a result of this arrangement, the material dumped into the chute falls into the tube 24 and is forced, by the rams 43, up into the lower end of the burning chamber 12. It will be appreciated that the 45° bend 42 in the embodiment shown can serve to increase the degree of compaction achieved by the rams 43.

In carrying out the invention, combustion air is conducted through a tube 50 passing through the joint 30 and ending in a nozzle 51 from which the air is jetted into the burning chamber 12. To initially ignite the material being burned, a burner 52 is positioned outside of the firebox 11 so as to project a flame into the burning chamber 12. Once ignited, the burner 52 can be turned off and continued flow of material to be burned from the rams 43, and continued flow of combustion air from the nozzle 51, will keep the combustion going in the chamber 12.

Preferably, the rate of material feed through the tube 24 is adjusted so that burning takes place just below the conical portion of the chamber 12 and within the cylindrical portion. Material that has not yet been burned in the cylindrical portion spills into the conical portion of the chamber, and the slow rotation of the chamber lifts that material and spills it back into the center cylindrical portion. Unburnable material is eventually forced off the open outer end of the cylindrical portion and down into the chute 19.

Because the combustion area is down in the cylindrical portion of the chamber 12 it is important to prevent backfiring down the tube 24 and to the area of the chute 40. This is achieved not only by adjusting the rate of material feed imposed by the rams, but also by tightly packing the material in the tube 24. As suggested above, the later result is obtained with the embodiment shown, in part, from the effect of the bend 42 in the tube 24. The bend 42 imposes frictional resistance to movement of the material to be burned through the tube 24, so that the rams can pack that material against that resistance. The so-packed material is thereafter forced through the relatively substantial length of the tube 24 between the bend 42 and the chamber 12. This seals the combustion region to the open top of the cylindrical portion of the chamber 12. It will be appreciated that the requisite degree of compaction can be achieved with alternative arrangements which eliminate the 45° bend.

It will be understood that the advantages outlined in said U.S. Pat. No. 3,822,651 that are obtained from a rotating combustion supporting structure formed by water carrying pipes are applicable to the incinerator 10. The incinerator design is suitable for smaller scale construction so as to produce a unit well adapted for installation in a hospital or small industrial plant.

I claim:

1. An incinerator comprising, in combination, a firebox, a funnel shaped burning chamber having a cylindrical portion and open end, said burning chamber rotatably supported in said firebox on an angle so that the lowermost conical portion of the chamber is substantially horizontal, a material receiving chute mounted outside of said firebox and opening into a cylindrical feeding tube, the cylindrical portion of said burning chamber extending through said firebox and being aligned with said feeding tube, a combustion air supply extending into said firebox and ending in a nozzle for driving air into the open end of the conical portion of the burning chamber, means for rotating said chamber about its axis, and means for forcing material from said feeding tube into and up the cylindrical portion of said burning chamber.

2. The combination of claim 1 in which said burning chamber is formed of a plurality of water carrying pipes bent and spiraled to form said conical portion, and a water circulation system including a steam chest connected to said pipes so as to carry water through the pipes of the burning chamber and the steam chest.

3. The combination of claims 1 or 2 in which said means for forcing material includes a pair of side-by-side, semicircular rams driven alternately within said feeding tube past said material receiving chute.

4. The combination of claim 3 in which the spacing between said rams and said cylindrical portion of the burning chamber is sufficiently long to permit material for burning to be compressed in the feeding tube prior to being forced into the burning chamber.

* * * * *